US007677055B2

(12) United States Patent
Kim et al.

(10) Patent No.: US 7,677,055 B2
(45) **Date of Patent: *Mar. 16, 2010**

(54) REFRIGERATOR

(75) Inventors: Ill-Shin Kim, Changwon (KR); Seon-Il Yu, An Yang (KR); Kun-Jun Seok, Seoul (KR); Yong-Chol Kwon, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 12/125,246

(22) Filed: May 22, 2008

(65) Prior Publication Data

US 2008/0216505 A1 Sep. 11, 2008

Related U.S. Application Data

(63) Continuation of application No. 10/549,934, filed as application No. PCT/KR2004/000692 on Mar. 26, 2004, now Pat. No. 7,484,382.

(30) Foreign Application Priority Data

Mar. 28, 2003 (KR) ..... 10-2003-0019726
Mar. 28, 2003 (KR) ..... 10-2003-0019727
Mar. 28, 2003 (KR) ..... 10-2003-0019732
Mar. 28, 2003 (KR) ..... 10-2003-0019733

(51) Int. Cl.
*F25C 1/12* (2006.01)

(52) U.S. Cl. ..... 62/344; 62/353

(58) Field of Classification Search ..... 62/344, 62/353, 440–441
See application file for complete search history.

(56) References Cited

U.S. PATENT DOCUMENTS

| | | | |
|---|---|---|---|
| 1,017,197 | A | 2/1912 | Barnes |
| 1,064,314 | A | 6/1913 | German |
| 1,377,411 | A | 5/1921 | Douglas |
| 1,377,455 | A | 5/1921 | Beidler |
| 1,604,621 | A | 10/1926 | Wallace |
| 2,139,441 | A | 12/1938 | Clarke |

(Continued)

FOREIGN PATENT DOCUMENTS

CN 1104608 10/1991

(Continued)

OTHER PUBLICATIONS

Japanese Office Action issued in Japanese Application No. 2006-507773, dated Jun. 2, 2009, 3 pages.

(Continued)

*Primary Examiner*—William E Tapolcai
(74) *Attorney, Agent, or Firm*—Fish & Richardson, P.C.

(57) ABSTRACT

According to one aspect, there is provided a refrigerator including a refrigerating chamber formed at a relatively upper portion of a refrigerator body and a freezing chamber formed at a relatively lower portion of the refrigerator body, which comprises an ice-making chamber which is partitioned in the refrigerating chamber by insulating walls and includes an icemaker for making ice and an ice storage for storing the ice made in the icemaker. The temperature in the refrigerating chamber can be accurately controlled, the loss of cold air can be minimized and the structures for supplying water into the icemaker and the dispenser can be simplified.

19 Claims, 7 Drawing Sheets

U.S. PATENT DOCUMENTS

| | | | | | |
|---|---|---|---|---|---|
| 2,223,947 | A | | 12/1940 | Blood | |
| 2,256,551 | A | | 9/1941 | Colvin | |
| 2,400,634 | A | | 5/1946 | Earle | |
| 2,410,334 | A | | 10/1946 | Brace | |
| 2,493,488 | A | | 1/1950 | Jordan | |
| 2,544,394 | A | | 3/1951 | Muffly | |
| 2,605,621 | A | | 8/1952 | Kellershon | |
| 2,692,809 | A | * | 10/1954 | Kesling | 312/405 |
| 2,712,733 | A | | 7/1955 | King | |
| 2,717,505 | A | | 9/1955 | Andersson | |
| 2,730,865 | A | | 1/1956 | Murdock | |
| 2,765,633 | A | | 10/1956 | Muffly | |
| 2,774,224 | A | | 12/1956 | Bayston | |
| 2,779,165 | A | | 1/1957 | Pichler | |
| 2,795,117 | A | | 6/1957 | Herndon, Jr. | |
| 2,907,180 | A | | 10/1959 | Mann | |
| 3,004,309 | A | | 10/1961 | Korodi | |
| 3,025,679 | A | | 3/1962 | Keighley | |
| 3,046,754 | A | | 7/1962 | Kniffin | |
| 3,048,023 | A | | 8/1962 | Taylor | |
| 3,060,700 | A | | 10/1962 | Vincent | |
| 3,070,852 | A | | 1/1963 | Hilliker | |
| 3,077,644 | A | | 2/1963 | Kesling | |
| 3,100,970 | A | | 8/1963 | Elfving | |
| 3,122,005 | A | | 2/1964 | Constantini | |
| 3,126,714 | A | | 3/1964 | Zuercher, Jr. | |
| 3,146,601 | A | | 9/1964 | Gould | |
| 3,146,606 | A | * | 9/1964 | Grimes et al. | 62/233 |
| 3,151,472 | A | | 10/1964 | Harle | |
| 3,182,464 | A | | 5/1965 | Archer | |
| 3,192,726 | A | | 7/1965 | Newton | |
| 3,216,776 | A | | 11/1965 | Carbary | |
| 3,225,559 | A | | 12/1965 | Fischer | |
| 3,226,939 | A | | 1/1966 | Harbison | |
| 3,248,159 | A | | 4/1966 | Hall | |
| 3,270,519 | A | | 9/1966 | Pohl, Jr. | |
| 3,273,353 | A | | 9/1966 | Horvay | |
| 3,308,631 | A | | 3/1967 | Kniffin | |
| 3,350,899 | A | | 11/1967 | Jones | |
| 3,359,751 | A | | 12/1967 | Stevens | |
| 3,364,694 | A | | 1/1968 | Cohen | |
| 3,382,682 | A | | 5/1968 | Frohbieter | |
| 3,440,308 | A | | 4/1969 | Carbary | |
| 3,466,804 | A | | 9/1969 | Swaneck, Jr. | |
| 3,541,806 | A | | 11/1970 | Jacobs | |
| 3,561,231 | A | | 2/1971 | Webb | |
| 3,568,465 | A | | 3/1971 | Jung | |
| 3,572,049 | A | | 3/1971 | Moorman | |
| 3,581,516 | A | | 6/1971 | Buchser | |
| 3,602,007 | A | | 8/1971 | Drieci | |
| 3,633,374 | A | | 1/1972 | Canter | |
| 3,640,088 | A | | 2/1972 | Jacobus | |
| 3,654,772 | A | | 4/1972 | Curry, III | |
| 3,745,779 | A | | 7/1973 | Bright | |
| 3,747,363 | A | | 7/1973 | Grimm | |
| 3,775,994 | A | | 12/1973 | Linstromberg | |
| 3,788,089 | A | | 1/1974 | Graves | |
| 3,789,620 | A | | 2/1974 | Benasutti | |
| 3,821,881 | A | | 7/1974 | Harkias | |
| 3,834,177 | A | | 9/1974 | Scarlett | |
| 3,850,008 | A | | 11/1974 | Frazier | |
| 3,866,434 | A | | 2/1975 | Pugh | |
| 3,889,888 | A | | 6/1975 | Prada | |
| 3,902,331 | A | | 9/1975 | True, Jr. | |
| 3,972,204 | A | | 8/1976 | Sidorenko | |
| 4,003,214 | A | | 1/1977 | Schumacher | |
| 4,007,600 | A | | 2/1977 | Simms | |
| 4,020,644 | A | | 5/1977 | True, Jr. | |
| 4,036,620 | A | | 7/1977 | Benasutti | |
| 4,084,725 | A | | 4/1978 | Buchser | |
| 4,087,140 | A | | 5/1978 | Linstromberg | |
| 4,100,761 | A | | 7/1978 | Linstromberg | |
| 4,118,451 | A | | 10/1978 | Schaus | |
| 4,142,373 | A | | 3/1979 | Weibel, Jr. | |
| 4,142,377 | A | | 3/1979 | Fogt | |
| 4,142,378 | A | | 3/1979 | Bright | |
| 4,223,538 | A | | 9/1980 | Braden | |
| 4,226,489 | A | | 10/1980 | Haag | |
| 4,227,383 | A | | 10/1980 | Horvay | |
| 4,250,923 | A | | 2/1981 | Johnson | |
| 4,280,682 | A | | 7/1981 | Zukausky | |
| 4,285,212 | A | | 8/1981 | Prada | |
| 4,306,757 | A | | 12/1981 | Horvay | |
| 4,332,146 | A | | 6/1982 | Yamazaki | |
| 4,487,024 | A | | 12/1984 | Fletcher | |
| 4,543,800 | A | | 10/1985 | Mawby | |
| 4,587,810 | A | | 5/1986 | Fletcher | |
| 4,614,088 | A | | 9/1986 | Brooks | |
| 4,628,699 | A | | 12/1986 | Mawby | |
| 4,644,753 | A | | 2/1987 | Burke | |
| 4,711,098 | A | | 12/1987 | Kuwabara | |
| 4,727,720 | A | | 3/1988 | Wernicki | |
| 4,732,009 | A | | 3/1988 | Frohbieter | |
| 4,754,615 | A | | 7/1988 | Linstromberg | |
| 4,756,165 | A | | 7/1988 | Chestnut | |
| 4,799,362 | A | | 1/1989 | Chestnut | |
| 4,831,840 | A | | 5/1989 | Fletcher | |
| 4,835,978 | A | | 6/1989 | Cole | |
| 4,838,026 | A | | 6/1989 | Searl | |
| 4,852,359 | A | | 8/1989 | Manzotti | |
| 4,872,317 | A | | 10/1989 | Reed | |
| 4,889,316 | A | | 12/1989 | Donahue, Jr. | |
| 4,916,921 | A | | 4/1990 | Fletcher | |
| 4,922,725 | A | | 5/1990 | Rasmussen | |
| 4,961,320 | A | | 10/1990 | Gutmann | |
| 4,970,871 | A | | 11/1990 | Rudick | |
| 4,997,109 | A | | 3/1991 | Carper | |
| 5,010,738 | A | | 4/1991 | Brown | |
| 5,033,636 | A | | 7/1991 | Jenkins | |
| 5,037,004 | A | | 8/1991 | Katz | |
| 5,056,688 | A | | 10/1991 | Goetz | |
| 5,090,208 | A | | 2/1992 | Aono | |
| 5,117,654 | A | | 6/1992 | Steffenhagen | |
| 5,198,244 | A | | 3/1993 | Rice | |
| 5,211,462 | A | | 5/1993 | Bien | |
| 5,212,955 | A | | 5/1993 | Hogan | |
| 5,219,225 | A | | 6/1993 | Ball | |
| 5,261,248 | A | | 11/1993 | Willis | |
| 5,272,888 | A | | 12/1993 | Fisher | |
| 5,273,219 | A | | 12/1993 | Beach, Jr. | |
| 5,309,680 | A | | 5/1994 | Kiel | |
| 5,310,090 | A | | 5/1994 | Taylor, Jr. | |
| 5,327,856 | A | | 7/1994 | Schroeder | |
| 5,355,686 | A | | 10/1994 | Weiss | |
| 5,357,769 | A | | 10/1994 | Crabtree | |
| 5,375,432 | A | | 12/1994 | Cur | |
| 5,388,427 | A | | 2/1995 | Lee | |
| 5,425,205 | A | | 6/1995 | Ha | |
| 5,542,264 | A | | 8/1996 | Hortin | |
| 5,542,265 | A | | 8/1996 | Rutland | |
| 5,551,252 | A | | 9/1996 | Lee | |
| 5,596,182 | A | | 1/1997 | Edwards | |
| 5,642,628 | A | | 7/1997 | Whipple, III | |
| 5,711,159 | A | | 1/1998 | Whipple, III | |
| 5,715,699 | A | | 2/1998 | Coates | |
| 5,729,997 | A | | 3/1998 | Witsoe | |
| 5,758,512 | A | | 6/1998 | Peterson | |
| 5,787,723 | A | | 8/1998 | Mueller | |
| 5,810,331 | A | | 9/1998 | Smock | |
| 5,816,060 | A | | 10/1998 | Brownell | |
| 5,816,080 | A | | 10/1998 | Jeziorowski | |
| 5,823,001 | A | | 10/1998 | Patrick | |
| 5,829,263 | A | | 11/1998 | Park | |
| 5,834,126 | A | | 11/1998 | Sheu | |

| | | | |
|---|---|---|---|
| 5,846,446 | A | 12/1998 | Jackson |
| 5,849,227 | A | 12/1998 | Chikugo |
| 5,899,083 | A | 5/1999 | Peterson |
| 5,907,958 | A | 6/1999 | Coates |
| 5,947,342 | A | 9/1999 | Song |
| 5,956,967 | A | 9/1999 | Kim |
| 5,975,664 | A | 11/1999 | Banicevic |
| 5,992,167 | A | 11/1999 | Hill |
| 6,019,447 | A | 2/2000 | Jackovin |
| 6,041,607 | A | 3/2000 | Kim |
| 6,050,097 | A | 4/2000 | Nelson |
| 6,053,472 | A | 4/2000 | DeLand |
| 6,055,826 | A | 5/2000 | Hiraoka |
| 6,062,826 | A | 5/2000 | Morimoto |
| 6,082,130 | A | 7/2000 | Pastryk |
| 6,090,281 | A | 7/2000 | Buckner |
| 6,091,062 | A | 7/2000 | Pfahnl |
| 6,148,620 | A | 11/2000 | Kumagai |
| 6,148,624 | A | 11/2000 | Bishop |
| 6,176,099 | B1 | 1/2001 | Hynes |
| 6,220,682 | B1 | 4/2001 | Vertullo |
| 6,286,324 | B1 | 9/2001 | Pastryk |
| 6,312,608 | B1 | 11/2001 | Buckner |
| 6,314,745 | B1 | 11/2001 | Janke |
| D452,255 | S | 12/2001 | Chai |
| 6,337,015 | B1 | 1/2002 | Poirier |
| 6,351,955 | B1 | 3/2002 | Oltman |
| 6,351,958 | B1 | 3/2002 | Pastryk |
| 6,351,967 | B1 | 3/2002 | Adachi |
| 6,401,461 | B1 | 6/2002 | Harrison |
| 6,412,286 | B1 | 7/2002 | Park |
| 6,422,031 | B1 | 7/2002 | Mandel |
| 6,425,425 | B2 | 7/2002 | Bianchi |
| 6,438,976 | B2 | 8/2002 | Shapiro |
| 6,438,988 | B1 | 8/2002 | Paskey |
| 6,442,954 | B1 | 9/2002 | Shapiro |
| 6,464,854 | B2 | 10/2002 | Andrews |
| 6,474,094 | B2 | 11/2002 | Kim |
| 6,497,113 | B1 | 12/2002 | Yamada |
| 6,550,268 | B2 | 4/2003 | Lee |
| 6,574,974 | B1 | 6/2003 | Herzog |
| 6,604,377 | B2 | 8/2003 | Watanabe |
| 6,612,116 | B2 | 9/2003 | Fu |
| 6,655,166 | B1 | 12/2003 | Williams |
| 6,694,754 | B1 | 2/2004 | Schenk |
| 6,708,726 | B2 | 3/2004 | Hashimoto |
| 6,725,680 | B1 | 4/2004 | Schenk |
| 6,732,537 | B1 | 5/2004 | Anell |
| 6,735,959 | B1 | 5/2004 | Najewicz |
| 6,735,974 | B2 | 5/2004 | Oh |
| 6,742,353 | B2 | 6/2004 | Ohashi |
| 6,755,166 | B2 | 6/2004 | Chang |
| 6,820,433 | B2 | 11/2004 | Hwang |
| 6,845,631 | B1 | 1/2005 | Hallin |
| 6,880,355 | B2 | 4/2005 | Jung |
| 6,964,177 | B2 | 11/2005 | Lee |
| 6,978,626 | B2 | 12/2005 | Kim |
| 7,008,032 | B2 | 3/2006 | Chekal |
| 7,428,820 | B2 | 9/2008 | Kim et al. |
| 7,430,873 | B2 | 10/2008 | Kim et al. |
| 7,484,382 | B2 | 2/2009 | Kim et al. |
| 7,490,475 | B2 | 2/2009 | Kim et al. |
| 7,490,474 | B2 | 4/2009 | Kim et al. |
| 7,520,138 | B2 | 4/2009 | Kim et al. |
| 7,520,139 | B2 | 4/2009 | Kim et al. |
| 2001/0025505 | A1 | 10/2001 | Nelson |
| 2002/0121096 | A1 | 9/2002 | Harrison |
| 2002/0124576 | A1 | 9/2002 | Loibl |
| 2003/0010056 | A1 | 1/2003 | Sakamoto |
| 2003/0046947 | A1 | 3/2003 | Ohya |

FOREIGN PATENT DOCUMENTS

| | | |
|---|---|---|
| EP | 0 657 706 | 6/1995 |
| EP | 0 715 136 | 5/1996 |
| EP | 1 445 558 | 11/2004 |
| GB | 2 167 544 | 5/1986 |
| GB | 2 242 731 | 10/1991 |
| JP | 50-069644 | 6/1975 |
| JP | 54-139143 | 10/1979 |
| JP | 56-113417 | 9/1981 |
| JP | 04-124570 | 4/1992 |
| JP | 06-011228 | 1/1994 |
| JP | 08-338681 | 12/1996 |
| JP | 09-113116 | 5/1997 |
| JP | 09-196548 | 7/1997 |
| JP | 11-304331 | 11/1999 |
| JP | 2000-009372 | 1/2000 |
| JP | 2000-065458 | 3/2000 |
| JP | 2000-111229 | 4/2000 |
| JP | 2002-228316 | 8/2002 |
| JP | 2003-56966 | 2/2003 |
| KR | 98-83727 | 12/1998 |
| WO | WO03/102481 | 12/2003 |

OTHER PUBLICATIONS

USPTO Non-Final Office Action in U.S. Appl. No. 12/117,331, mailed Oct. 10, 2008, 15 pages.

USPTO Non-Final Office Action in U.S. Appl. No. 12/117,413, mailed Oct. 22, 2008, 14 pages.

USPTO Non-Final Office action in U.S. Appl. No. 12/125,127, mailed Jan. 29, 2009, 17 pages.

USPTO Notice of Allowance in U.S. Appl. No. 12/125,275, mailed Mar. 10, 2009, 7 pages.

USPTO Non-Final Office Action in U.S. Appl. No. 12/125,110, mailed Mar. 10, 2009, 15 pages.

USPTO Final Office Action issued in U.S. Appl. No. 12/117,331, mailed May 18, 2009, 9 pages.

USPTO Final Office Action issued in U.S. Appl. No. 12/117,413, mailed Jun. 2, 2009, 9 pages.

Office Action issued in U.S. Appl. No. 12/125,110, mailed Dec. 2, 2009, 5 pages.

* cited by examiner

REFRIGERATOR

TECHNICAL FIELD

The present invention relates to a refrigerator, and more particularly, to a refrigerator wherein a refrigerating chamber is provided at a relatively upper portion thereof, a freezing chamber is provided at a relatively lower portion thereof, and a structure for making ice is also provided in the refrigerating chamber.

BACKGROUND ART

FIG. 1 shows the configuration of a side-by-side refrigerator in which a refrigerating chamber and a freezing chamber are provided to stand together side by side. Referring to this figure, a refrigerator body 100 includes the freezing and refrigerating chambers which are open toward a front direction and stand together side by side. The refrigerating and freezing chambers are opened and closed by a door 102 of the freezing chamber and a door 104 of the refrigerating chamber, respectively. The doors 102 and 104 are pivotally supported by hinges 102' and 104' provided at upper and lower ends of both lateral sides of the refrigerator body 100, respectively.

An icemaker 106 is provided in the freezing chamber, and a water tank 108 is provided in the refrigerating chamber. Water supplied to the icemaker 106 and water tank 108 is beforehand purified by means of a filter 110. The water is supplied from an external water source Ws to the icemaker and water tank through the filter 110.

Further, a dispenser 112 is provided on a front surface of the door 102 of the freezing chamber. The dispenser 112 allows a user to drink the water supplied from the water tank 108 without opening the door.

Here, the supply of water into the refrigerator body 100 is made through a plurality of supply tubes 110', 106', 108' and 112' and valves **110*v* and 106*v*. The water is supplied to the dispenser 112 through the supply tube 112' that penetrates through the lower hinge 102'**.

However, the aforementioned related art refrigerator has the following problems.

Since the icemaker 106 is provided in the freezing chamber and the water tank 108 is provided in the refrigerating chamber while the dispenser 112 that receives water from the water tank 108 is installed on the door 102 of the freezing chamber, the supply tubes 110', 106', 108' and 112' for supplying the icemaker, the water tank and the dispenser with the water are installed in the refrigerator body 100 in a complicated manner. Therefore, since the total length of supply tubes 110', 106', 108' and 112' are increased, there is a problem in that the manufacturing cost thereof are increased and the manufacturing process is also complicated.

Further, since the icemaker 106 is provided in the refrigerating chamber, there is also another problem in that the supply tube 106' may be frozen at an interval where it penetrates through the freezing chamber. To solve this problem, an additional heater should be used in the supply tube 106'. However, the manufacturing cost and power consumption of the refrigerator are increased due to the use of an additional heater.

Since the icemaker 106 should be placed in a low-temperature environment where ice can be made, it is generally installed in the freeing chamber. In some design conditions, however, there is a limitation on the installation of the icemaker 106 depending on where the freezing chamber should be disposed. For example, if the dispenser is installed on a front surface of the door of the freezing chamber in a case where the freezing chamber is formed at a relatively lower portion of the refrigerator body, it is very inconvenient of a general user to take the ice from the dispenser.

On the other hand, if the icemaker is installed in the freezing chamber in a case where the freezing chamber is formed at the lower portion of the refrigerator body and the refrigerating chamber is formed at an upper portion of the refrigerator body as mentioned above, there is a further problem in that it is difficult to control the temperature of the refrigerating chamber or the ice-making capability of the icemaker is lowered.

In addition, in a case where a single door 102 or 104 is used to open and close the freeing or refrigerating chamber of the refrigerator body 100, there is a further problem in that the loss of cold air from the chamber is increased. In particular, since the size of the refrigerator has been recently tending to increase, the loss of cold air becomes relatively larger.

DISCLOSURE OF INVENTION

Accordingly, the present invention is conceived to solve the aforementioned problems in the prior art. An object of the present invention is to provide a refrigerator wherein an icemaker is provided in a refrigerating chamber formed at an upper portion of a refrigerator body.

Another object of the present invention is to provide a refrigerator wherein the loss of cold air from a storage space can be minimized when the storage space is opened and closed.

A further object of the present invention is to provide a refrigerator including an icemaker and dispenser wherein a structure for feeding water can be simplified.

According to an aspect of the present invention for achieving the object, there is provided a refrigerator including a refrigerating chamber formed at a relatively upper portion of a refrigerator body and a freezing chamber formed at a relatively lower portion of the refrigerator body, which comprises an ice-making chamber portioned in the refrigerating chamber by means of insulating walls and including an icemaker for making ice and an ice storage for storing the ice made in the icemaker, one or more heat exchangers serving as components of a heat exchange cycle for generating cold air to regulate temperatures in the refrigerating and freezing chambers, and a dispenser communicating with the ice storage and installed on a door.

Preferably, a first heat exchanger is provided in the ice-making chamber and a second heat exchanger is provided in the freeing chamber.

The second heat exchanger may be provided in a heat exchange chamber separately partitioned at a rear portion of the freezing chamber and communicate with the freezing and refrigerating chambers.

Preferably, a blow fan for sending the cold air generated in the second heat exchanger to the freezing and refrigerating chambers is further provided in the heat exchange chamber.

The ice-making chamber may be detachably installed in the refrigerating chamber.

The refrigerating chamber may be opened and closed by a pair of doors that are pivotally supported on hinges provided at upper and lower ends of both lateral sides of the refrigerator body.

The ice-making chamber maybe provided at one side of the door.

The doors of the refrigerating chamber may have widths different from each other.

Preferably, gaskets are provided at free tip ends of the doors of the refrigerating chamber such that they are brought into close contact with each other when the doors are closed.

The dispenser that is provided on a front surface of the door of the refrigerating chamber may be supplied with water from a water tank installed in the refrigerating chamber.

The water tank may be installed at an inner side of the refrigerator body or the door of the refrigerating chamber.

The water supplied from an external water source may be delivered into the water tank and the icemaker of the ice-making chamber through a filter, and tubes for feeding the water and valves for regulating flow of the water may be provided between the water source and the filter, between the filter and the water tank, and between the filter and the icemaker.

According to another aspect of the present invention, there is provided a refrigerator, which comprises a refrigerator body that includes components of a heat exchange cycle, a refrigerating chamber that is formed at a relatively upper portion of the refrigerator body, a freezing chamber that is formed at a relatively lower portion of the refrigerator body, a pair of doors that is connected at both lateral ends of the refrigerator body corresponding to the refrigerating chamber to open and close the refrigerating chamber, a door for selectively opening and closing a front face of the freezing chamber, and storage units for storing articles therein that are provided in the refrigerating chamber and have the same widths as the width of doors of the refrigerating chamber.

The pair of doors of the refrigerating chamber may have the same widths as each other, and gaskets may be provided on surfaces of opposite free ends of the doors such that they are brought into close contact with each other.

The pair of doors of the refrigerating chamber may have the different widths from each other, and gaskets may be provided on surfaces of opposite free ends of the doors such that they are brought into close contact with each other.

Preferably, an ice-making chamber, which includes an icemaker for making ice and an ice storage for storing the ice made in the icemaker and is partitioned as an individual space by means of insulating walls, is further provided in the refrigerating chamber.

The ice-making chamber may be detachably installed in the refrigerating chamber.

Preferably, a dispenser is further provided on a front surface of the door of the refrigerating chamber and is supplied with water from a water tank installed in the refrigerating chamber.

The water tank may be installed at an inner side of the refrigerator body or the door of the refrigerating chamber.

The water supplied from an external water source may be delivered into the water tank and the icemaker of the ice-making chamber through a filter. Further, tubes for feeding the water and valves for regulating flow of the water are preferably provided between the water source and the filter, between the filter and the water tank, and between the filter and the icemaker.

The door of the freezing chamber may be opened and closes in the same manner as a drawer.

According to a further aspect of the present invention, there is provided a refrigerator, which comprises a refrigerator body that includes components of a heat exchange cycle, a refrigerating chamber that is formed at a relatively upper portion of the refrigerator body, a freezing chamber that is formed at a relatively lower portion of the refrigerator body, a pair of doors that are connected at both lateral ends of the refrigerator body corresponding to the refrigerating chamber to open and close the refrigerating chamber, a door for selectively opening and closing a front face of the freezing chamber, an ice-making chamber that is partitioned as an individual space within the refrigerating chamber by means of insulating walls and includes an icemaker for making ice and an ice storage for storing the ice made in the icemaker, a first heat exchanger for generating cold air to regulate temperature in the ice-making chamber, and a second heat exchanger for generating cold air to regulate temperatures in the freezing and refrigerating chambers, wherein the first and second heat exchangers are components of the heat exchange cycle.

The pair of doors of the refrigerating chamber may have the same widths as each other. Preferably, gaskets are also preferably provided on surfaces of opposite free ends of the doors such that they are brought into close contact with each other, and storage units for storing articles therein are provided in the refrigerating chamber such that they have the same widths as the width of doors of the refrigerating chamber.

The pair of doors of the refrigerating chamber may have the different widths from each other. Preferably, gaskets are also provided on surfaces of opposite free ends of the doors such that they are brought into close contact with each other, and storage units for storing articles therein are provided in the refrigerating chamber such that they have the same widths as the width of doors of the refrigerating chamber.

Preferably, a dispenser is further provided on a front surface of the door of the refrigerating chamber and is supplied with water from a water tank installed in the refrigerating chamber.

The water rank may be installed at an inner side of the refrigerator body or the door of the refrigerating chamber.

The water that is supplied from an external water source may be delivered into the water tank and the icemaker of the ice-making chamber through a filter. Preferably, tubes for feeding the water and valves for regulating flow of the water are provided between the water source and the filter, between the filter and the water tank, and between the filter and the icemaker, and the tubes for feeding the water are provided on the door and the refrigerator body corresponding to the refrigerating chamber.

According to a still further aspect of the present invention, there is provided a refrigerator including a refrigerating chamber formed at a relatively upper portion of a refrigerator body and a freezing chamber formed at a relatively lower portion of the refrigerator body, which comprises an ice-making chamber that is portioned in the refrigerating chamber by means of insulating walls and includes an icemaker for making ice and an ice storage for storing the ice made in the icemaker, a door of the refrigerating chamber that opens and closes the refrigerating chamber and is formed with a dispenser installed at a front surface thereof, a water tank that is installed in the refrigerating chamber to store water supplied from a water source to the dispenser, a means for feeling water supplied from the water source into the dispenser, which is provided on the refrigerator body corresponding to the refrigerating chamber, and a means for feeding water supplied from the water source into the icemaker, which is provided on the refrigerator body corresponding to the refrigerating chamber.

The means for feeding water into the dispenser may include a filter for purifying water supplied from the water source; a tank tube for delivering water running from the filter to the water tank; a dispenser tube for delivering water from the water tank to the dispenser, and valves that are provided between the water source and the filter and between the filter and the dispenser to regulate flow of the water.

The means for feeding water into the icemaker may include a filter for purifying water supplied from the water source; an icemaker tube for delivering water running from the filter to the icemaker, and valves that are provided between the water source and the filter and between the filter and the icemaker to regulate flow of the water.

Preferably, the refrigerating chamber is opened and closed by at least a pair of doors of the refrigerating chamber having the same widths as each other.

Preferably, the refrigerating chamber is opened and closed by at least a pair of doors of the refrigerating chamber having different widths from each other.

BEST MODE FOR CARRYING OUT THE INVENTION

Hereinafter, preferred embodiments of a refrigerator according to the present invention will be described in detail with reference to the accompanying drawings.

Figure 1:
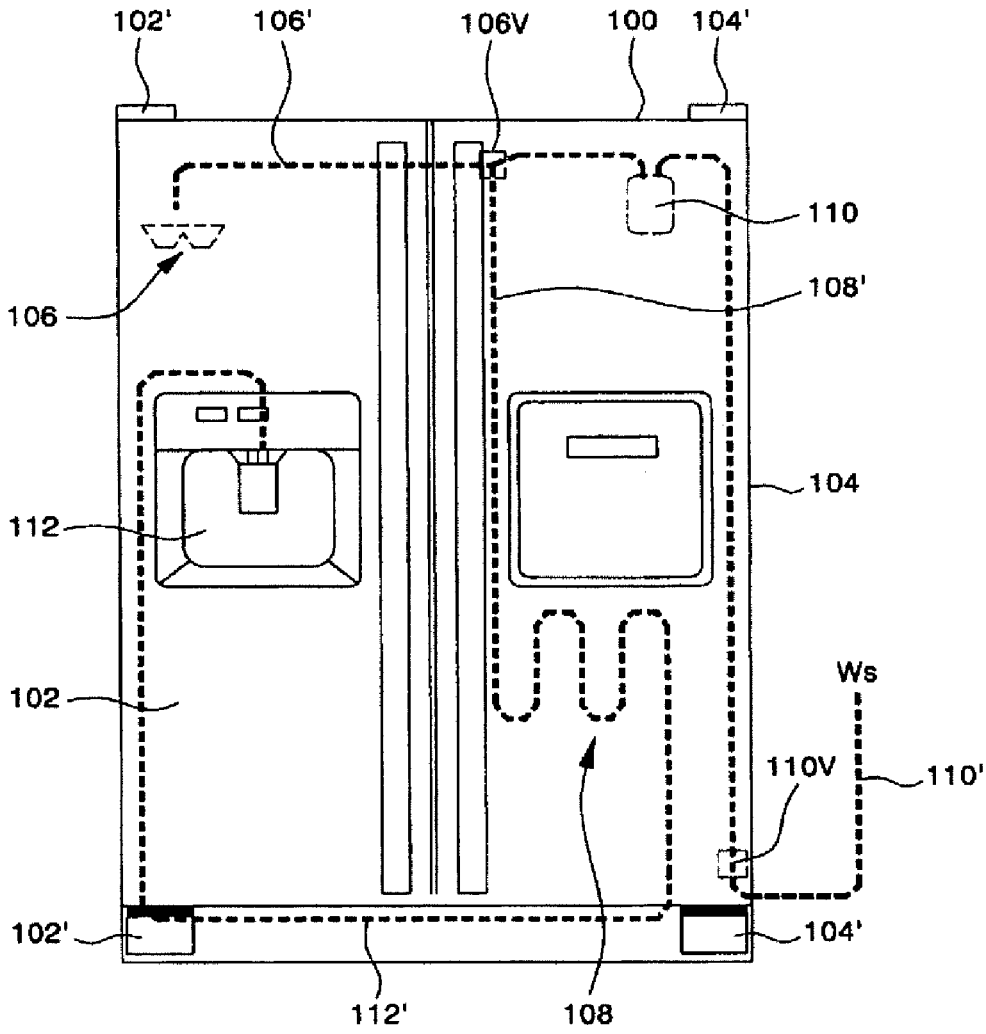
FIG. 1 is a front view showing the configuration of a related art refrigerator.
Figure 2:
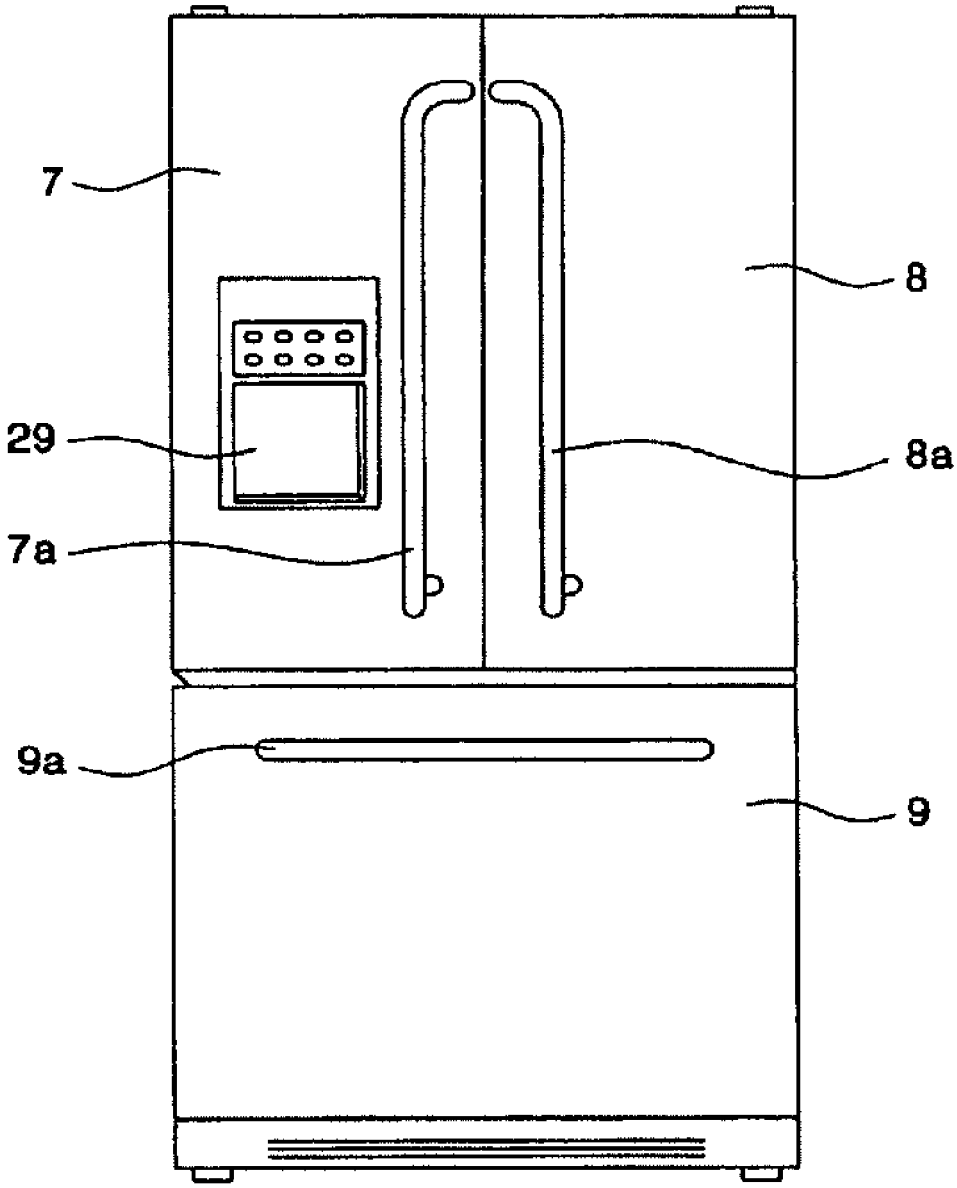
FIG. 2 is a front view showing the configuration of a first embodiment of a refrigerator according to the present invention.
Figure 3:
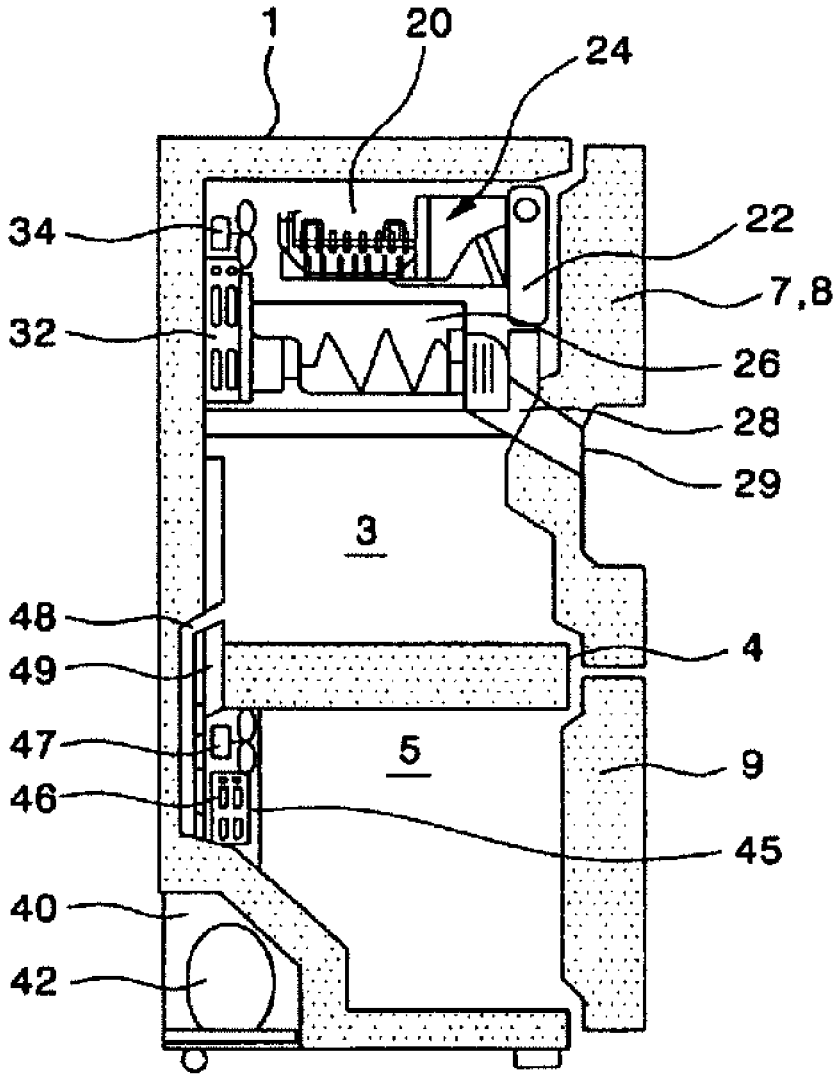
FIG. 3 is a sectional view showing the configuration of the first embodiment of the refrigerator according to the present invention shown in FIG. 2.

FIG. 2 shows a front view of an external appearance of a fist embodiment of a refrigerator according to the present invention, and FIG. 3 shows a sectional view of the internal configuration of the first embodiment of the refrigerator according to the present invention.

Referring to these figures, a storage space such as a refrigerating chamber 3 and a freezing chamber 5 is formed in a refrigerator body 1. The refrigerating chamber 3 is formed at a relatively upper portion of the refrigerator body 1, while the freezing chamber 5 is formed at a relatively lower portion of the refrigerator body 1. The refrigerator body 1 is vertically partitioned into the refrigerating and freezing chambers 3 and 5 by means of a barrier 4.

The refrigerating and freezing chambers 3 and 5 are formed to be open toward a front face of the refrigerator body 1, and their opened portions are opened and closed by doors 7, 8 and 9. In particular, the refrigerating chamber 3 is opened and closed by a pair of doors 7 and 8. The doors 7 and 8 of the refrigerating chamber are pivotally supported on hinges (not shown) that are installed at upper and lower ends of both lateral sides on the front face of the refrigerator body 1, respectively. That is, the doors 7 and 8 are configured such that their free ends, i.e. tip ends, which are adjacent to each other, are positioned in the middle of the refrigerating chamber 3 in a horizontal direction when the doors 7 and 8 are closed. The doors 7 and 8 of the refrigerating chamber selectively open and close right and left halves of the refrigerating chamber 3 corresponding to a single storage space.

Door handles 7*a* and 8*a* are provided on tip ends on front surfaces of the doors 7 and 8 of the refrigerating chamber, respectively. The door handles 7*a* and 8*a* correspond to parts that a user grips to exert a predetermined force thereon when intending to open and close the doors 7 and 8. A door handle 9*a* is also provided on an upper end on a front surface of the door 9 of the freezing chamber. For reference, the door 9 of the freezing chamber is configured such that it can be slid in and out in the same manner as a drawer.

Furthermore, an ice-making chamber 20 is installed at upper side of the refrigerating chamber 3. The ice-making chamber 20 is partitioned by means of insulating walls 22, because the temperature in the ice-making chamber 20 should be kept to be remarkably lower as compared to that in the refrigerating chamber 3. The insulating walls 22 are formed to completely wrap up the ice-making chamber 20 and includes an insulating material composed of polyurethane, Styrofoam or the like.

An icemaker 24 in which ice is actually made is provided in the ice-making chamber 20. Any kinds of icemakers may be used as the icemaker 24 if they can store the supplied water into an ice-making tray and freeze the water with using a low temperature in the ice-making chamber 20. Ice storage 26 is provided below the icemaker 24. The ice storage 26 is a part in which ice made in the icemaker 24 can be stored. The ice made in the icemaker 24 can be delivered to the ice storage 26 in various manners.

The ice storage 26 temporarily stores the ice delivered from the icemaker 24, and the ice stored in the ice storage 26 is transported by a mechanism for delivering the ice (e.g., screw wires capable of moving the ice by means of their rotation). The ice storage 26 in communication with an ice discharge duct 28 that penetrates through the insulating ducts 22, and the ice discharge duct 28 is selectively opened and closed such that the ice can be transferred to a dispenser 29 provided on the front surface of the door 7. The ice discharge duct 28 is formed on the door 7 such that it communicates outwardly with the dispenser 29 and inwardly with ice storage 26 through insulating walls 22 of the ice-making chamber 20.

The dispenser 29 allows a user to take water and ice without opening and closing the door 7. The dispenser 29 is provided with a structure for taking the water and ice from the dispenser. For example, an operating lever or button, which receives a signal for opening and closing a dispensing port through which water or ice is discharged, is exposed or provided on the front surface of the door 7. That is, the dispensing port is opened by the operating lever or button, whereby the water or ice is discharged to the outside.

A separate evaporator 32 is installed within the ice-making chamber 20. The evaporator 32 is installed to allow the ice-making chamber 20 to be cool down (to a low temperature where water stored in the ice-making chamber can be frozen) by performing heat exchange between ambient air in the ice-making chamber and coolant that is changed to a low-temperature and low-pressure state and then introduced into the ice-making chamber by means of a compressor 42 and a condenser (not shown) installed within a machine room 40 formed at a lower rear portion of the refrigerator body 1.

In addition, a blow fan 34 may also be installed such that cold air produced by the contact with evaporator 32 can be transferred more quickly into the ice-making chamber 20. Any kinds of evaporator can also be used if the evaporator 32 is able to produce low-temperature air through the heat exchange with the ambient air. For example, an evaporator to which direct cooling mode can be applied without using the blow fan 34 may also be used.

Next, the structure for supplying cold air to the refrigerating and freezing chambers 3 and 5 formed in the refrigerator body 1 will be described. A separate heat exchange chamber 45 is formed in a rear portion of the freezing chamber 5 of the refrigerator body 1. An evaporator 46 and a blow fan 47 are provided in the heat exchange chamber 45. The evaporator 46 produces cold air by using a low-temperature and low-pressure liquid coolant that is supplied from the compressor 42 and the condenser (not shown) installed within the machine room 40. The blow fan 47 serves to provide the refrigerating and freezing chambers 3 and 5 with the cold air produced in the evaporator 46.

A portion of the cold air produced in the heat exchange chamber 45 is directly supplied to the freezing chamber 5 my means of the blow fan 47. The other portion of the cold air is supplied to the refrigerating chamber 3. To this end, cold air supply and return ducts 48 and 49 are formed to pass through the insulating walls of the refrigerator body 1. The ducts 48 and 49 allow the heat exchange chamber 45 and the refrigerating chamber 3 to communicate with each other. The ducts 48 and 49 are provided on a rear side and/or a rear wall surface of the barer 4.

Figure 4:
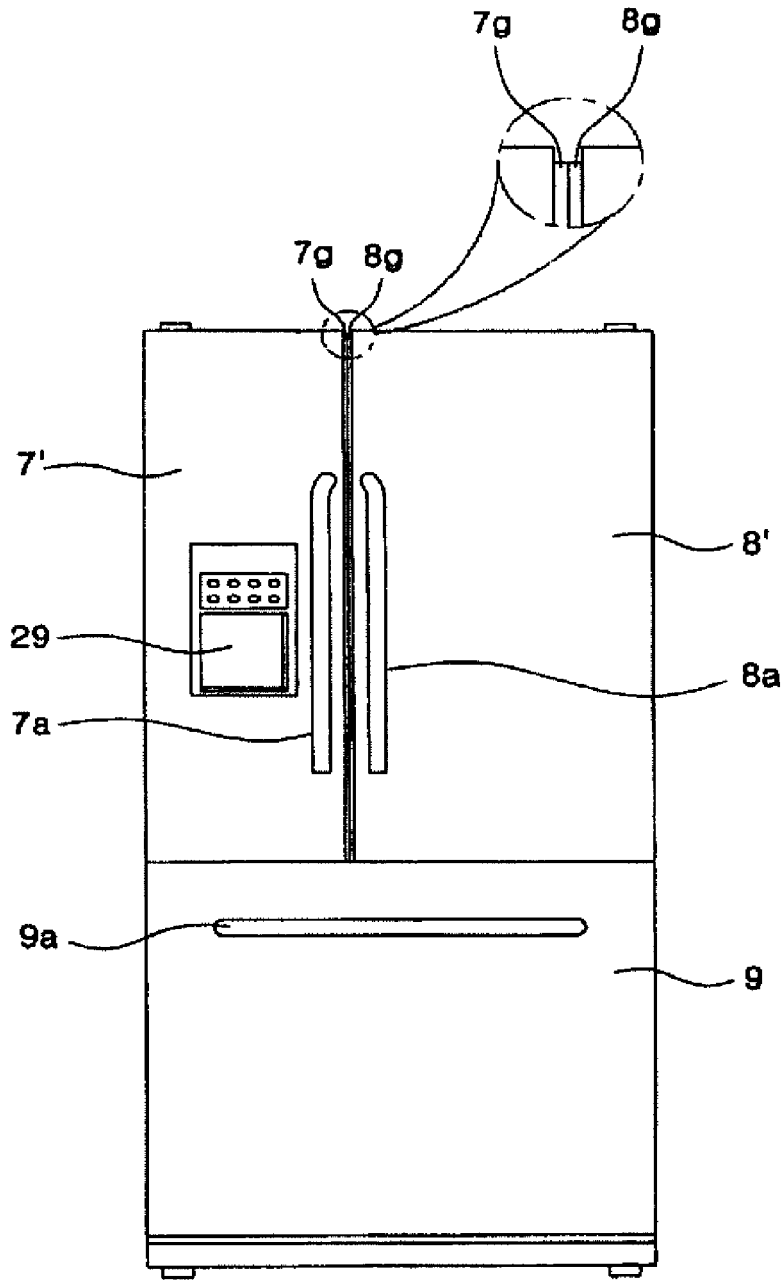
FIG. 4 is a front view showing the configuration of a refrigerator according to the present invention.
Figure 5:
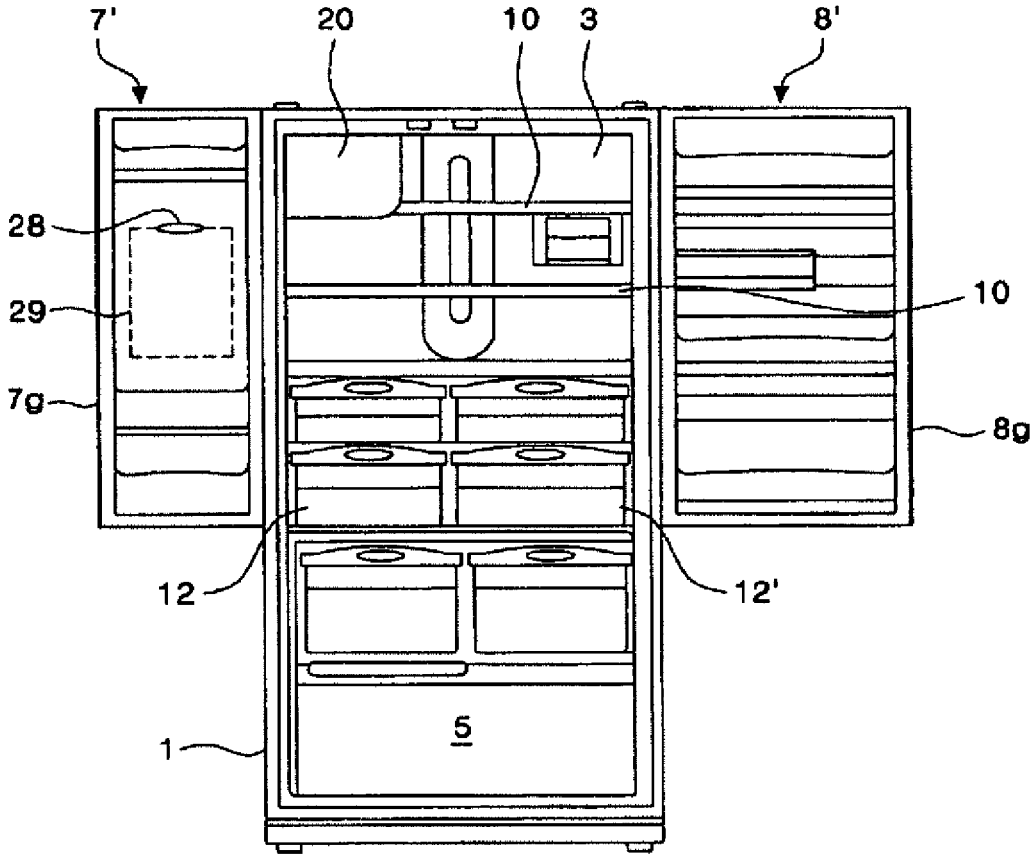
FIG. 5 is a front view showing the internal configuration of the second embodiment of the refrigerator shown in FIG. 4 in a state where doors of a refrigerating chamber is opened and doors of a freezing chamber is removed.

FIGS. 4 and 5 show a second embodiment of the present invention. In this embodiment, doors 7' and 8' for opening and closing the refrigerating chamber 3 corresponding to the storage space formed in the refrigerator body 1 are formed to have sizes different from each other, as shown in these figures. That is, the width of the left door 7' is smaller than that of the right door 8', as viewed from these figures.

This is because only a necessary portion of the increased refrigerating chamber 3 are opened to take foodstuffs in and out from the refrigerating chamber in accordance with the tendency of the size of refrigerators to increase. Of course, even though the two doors 7 and 8 having the same width as in the previous embodiment are used, an opened portion of the refrigerator maybe reduced when if a single door 7 or 8 is opened. If the doors 7' and 8' having the different width are used as in this embodiment, however, the unnecessary loss of cold air can be relatively further reduced.

Furthermore, when the doors 7' and 8' having the different width are employed, the inner structure of the refrigerating chamber 3 is preferably designed to be in harmony with the doors 7' and 8'. That is, a plurality of shelves 10 for the efficient use of the storage space are installed within the refrigerating chamber 3. The refrigerating chamber 3 is vertically partitioned by the shelves 10 on which foodstuffs can be placed and stored.

In addition, a plurality of drawer boxes 12 and 12' are provided in the refrigerating chamber 3. The drawer boxes 12 and 12' in which the foodstuffs can be stored is installed within the refrigerating chamber 3, but their interiors are completely separated from the refrigerating chamber 3. The widths of the drawer boxes 12 and 12' are determined in accordance with the widths of the doors 7' and 8', respectively. This is because when any one of the doors 7' and 8' is opened, the drawer box 12 or 12' corresponding to the opened door 7' or 8' can be pulled out without interfering with the closed door.

In the meantime, when the doors 7' and 8' are closed, gaskets 7*g* and 8*g* are preferably installed on opposite sides of the doors. The gaskets 7*g* and 8*g* are designed to have a length corresponding to a vertical length, i.e. a height, of the doors 7' and 8'. Accordingly, when the doors 7' and 8' are completely closed, the gaskets 7*g* and 8*g* are brought into close contact with each other. Therefore, the gaskets 7*g* and 8*g* can prevent the cold air from leaking out through the tip ends of the doors 7' and 8'. These gaskets may also be applied to the previous embodiment of the present invention.

Figure 6:
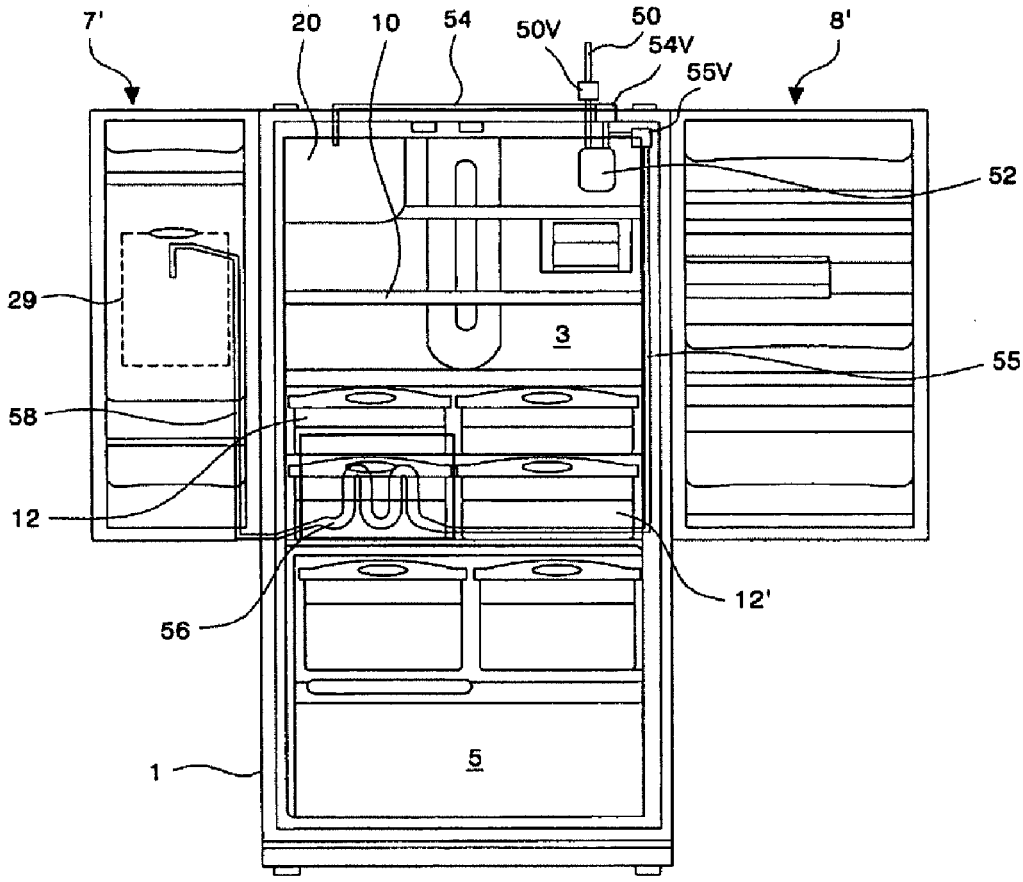
FIG. 6 is a front view showing the structure for supplying a dispenser and icemaker with water according to the embodiment of the present invention.

Next, the structure for supplying water to the dispenser and the icemaker according to the present invention will be described with reference to FIG. 6. The water supplied from a water source is introduced into the refrigerator body 1 and supplied to a filter 52 through a supply tube 50. The supply tube 50 is provided with a valve 50V for regulating the supply of water to the refrigerator body 1.

The filter 52 is to purify water supplied therein. The water purified in the filter 52 is transferred to the icemaker 24 and a water tank 56 through an icemaker tube 54 and a tank tube 55, respectively. The icemaker tube and tank tubes 54 and 55 are provided with valves 54V and 55V, respectively. Of course, the water may be supplied in such a manner that a single tube stems from the filter 52 and the icemaker tube 54 and the tank tube 55 are branched off through a single valve.

The water tank 56 serves to supply water to the dispenser 29 while causing a constant amount of water to be kept at the same state as in &e refrigerating chamber. The water tank 56 is connected to the dispenser 29 through a dispenser tube 58 to supply the water to the dispenser 29. The dispenser tube 58 is installed to penetrate through a lower hinge of the door 7' of the refrigerating chamber.

In this embodiment, since the water tank 56 is installed at a portion in the refrigerating chamber 3 and directly connected to the door 7', the water discharged from the dispenser 29 can be always kept at a refrigerating temperature.

Here, the tubes 54, 55 and 58 are preferably embedded into a rear side of an inner case or an insulating material of the walls of the refrigerating chamber 3 so that they are not exposed to the interior of the refrigerating chamber 3.

Figure 7:
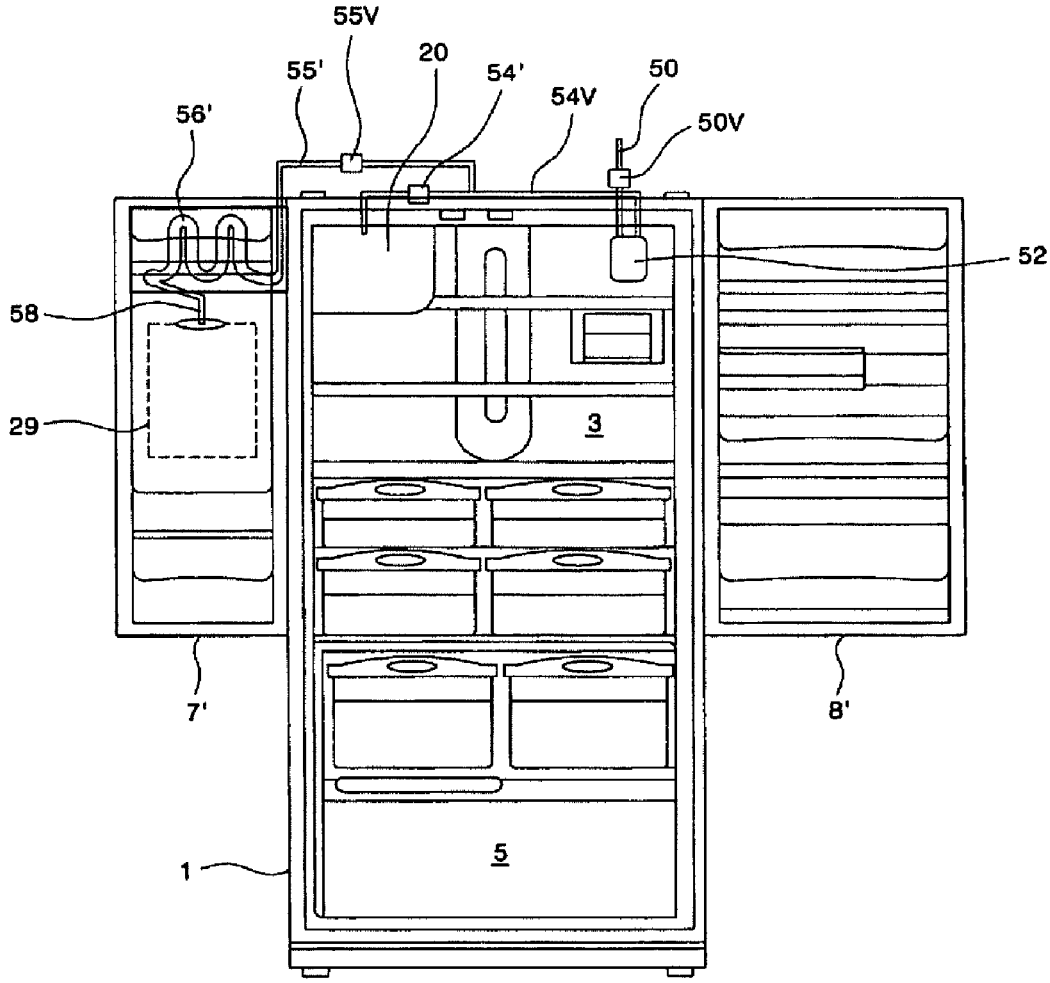
FIG. 7 is a view showing another example of the structure for supplying a dispenser and icemaker with water according to the embodiment of the present invention.

Next, a further embodiment of supplying water to the dispenser and icemaker will be described with reference to FIG. 7. In this embodiment, a supply tube 50 is connected from the water source to the refrigerator body 1. A filter 52 is installed on the refrigerator body 1 and connected to the supply tube 50. The filter 52 is to purify water supplied therein. The supply tube 50 is provided with a valve 50V for regulating the supply of water to the filter 52.

An icemaker tube 54' connects the filter 52 and the icemaker 24 with each other and includes a valve 54V. The water is supplied to the icemaker 24 though the icemaker tube 54'. A tank tube 55' should be branched off from the icemaker tube 54' between the valve 54V and the filter 52. The tank tube 55' supplies water to a water tank 56' to be explained later and is also provided with a valve 55V. Of course, to regulate the water to be supplied to the icemaker tube 54' and tank tube 55', a single valve may be used at a portion where the tubes 54' and 55' are branched off.

The water tank 56' is provided on the door 7' of the refrigerating chamber on which the dispenser 29 is installed. The water tank 56' serves to temporarily store the water purified in the filter 52 and then supply the stored water to the dispenser 29. Since the water tank 56' is installed on the door 7' of the refrigerating chamber, the tank tube 55' is connected to the door 7' while penetrating though an upper hinge of the door 7'. The water tank 56' and the dispenser 29, both of which are provided on the door 7' of the refrigerating chamber, are connected with each other through a dispenser tube 58.

Hereinafter, the operation of the refrigerator according to the present invention configured as above will be described in detail.

First, it is explained how the refrigerator of the present invention is operated. When the refrigerator is driven, a heat exchange cycle including the compressor 42 and the evaporator 46 provided in the machine chamber 40 is operated and cold air is then produced. The cold air is supplied to the freezing and refrigerating chambers 5 and 3 by means of the blow fan 47. The cold air supplied to the freezing chamber 5 circulates in the freezing chamber and is then returned to the heat exchange chamber 45. The cold air is supplied into the refrigerating chamber 3 through the cold air supply duct 48 and is returned to the heat exchange chamber 45 through the return duct 49 after circulating in the refrigerating chamber 3.

Further, cold air is supplied to the icemaker 24 from the evaporator 32 separately provided in the ice-making chamber 20. Since the ice-making chamber 20 is separated from the refrigerating chamber 3 by means of the insulating walls 22, there is no flow of the cold air between the ice-making chamber and the refrigerating chamber. To supply the cold air to the ice-making chamber 20, the heat exchange cycle including the evaporator 32 and the compressor 42 in the machine room 40 should be operated. The cold air formed in the evaporator 32 is delivered into the ice-making chamber 20 by means of the blow fan 34 such that ice is made in the icemaker 24.

Here, the ice-making chamber 20 is separated from the refrigerating chamber 3 by means of the insulating walls 22 and supplied with the cold air from the additional evaporator 32 other than the evaporator for use in the refrigerating and freezing chambers 3 and 5. Therefore, the temperatures in the refrigerating chamber 3 and ice-making chamber 20 are controlled separately from each other.

For reference, the ice-making chamber 20 corresponds to a space separated from the refrigerating chamber by means of the insulating walls 22. Therefore, various modifications or changes on the shapes of the insulating walls 22 can be made within the technical scope in which they can substantially define an additional ice-making space in the refrigerating chamber 3.

That is, the ice-making chamber 20 itself may be configured to be detachably installed in the refrigerating chamber 3. More specifically, the insulating walls 22 can be configured in the form of a box so as to construct the ice-making chamber 20. The present invention can be implemented by detachably installing the ice-making chamber 20 in the refrigerating chamber 3.

Accordingly, the internal space of the refrigerating chamber can be substantially utilized more effectively by detachably installing the individually formed ice-making chamber 20 into the refrigerating chamber 3 (for example, in the manufacturing line of the refrigerator). Further, if the ice-making chamber 20 is detachably configured, it can be contemplated that the ice-making chamber 20 is integrally formed with the icemaker, evaporator and the like.

Next, in the present invention, the refrigerating chamber 3 is opened and closed by the two doors 7, 8 or 7', 8'. Such a configuration can minimize the loss of cold air in accordance with the tendency of the size of refrigerators to increase. As the size of refrigerator is increased, the volume of refrigerator is also increased. In particular, since the ice-making chamber 20 is installed in the refrigerating chamber 3, the volume thereof can be relatively enlarged.

Therefore, a pair of doors 7, 8 or 7', 8' are configured to open and close the refrigerating chamber 3. That is, when a user wishes to take the foodstuffs in and out from a desired region of the refrigerating chamber 3, only one of the two doors 7, 8 or 7', 8' corresponding to the desired region can be opened and closed, thereby minimizing the loss of cold air from the refrigerating chamber. In particular, the loss of cold air can be further reduced by constructing the doors 7' and 8' having the different width, as shown in FIG. 4. To this end, the narrower door 7' may be installed at a region of the refrigerating chamber which is frequently opened and closed, or the user can intentionally store the foodstuffs, which are more frequently taken in and out, in a storage space where the narrower door 7' is installed.

As well shown in FIG. 5, the drawer boxes 12 and 12' used in the refrigerating chamber 3 are manufactured to have predetermined widths corresponding to those of the doors 7' and 8'. Accordingly, the foodstuffs can be taken in and out form the drawer boxes in a state where only a single door is opened.

On the other hand, according to the present invention, the freezing chamber 5 is located at a lower portion of the refrigerator, and the door 9 is slid in and out in the same manner as a drawer. Therefore, the user can open the freezing chamber by forwardly pulling the door and easily find out the contents stored in the freezing chamber from above.

Next, it is explained how water is supplied to the icemaker 24 and the dispenser 29. When the water is required in the icemaker 24 or the dispenser 29 (more specifically, water tank 56), the water is supplied from the water source to the refrigerator body 1. That is, the valve 50V is opened and the water is then supplied to the filter 52 from the water source. The water purified in the filter 52 is delivered into the icemaker 24 and the water tank 56, respectively, because the valves 54V and 55V have been already opened. At this time, the water flowing out from the filter 52 is supplied to the icemaker 24 through the icemaker tube 54 or 54' and to the water tank 56 through the tank tube 55 or 55'.

The water supplied to the icemaker 24 is converted into ice, and the ice is then delivered into the ice storage 26. The ice can be automatically or manually delivered from the icemaker 24 into the ice storage 26. The ice stored in the ice storage 26 can be discharged to the outside by operating the dispenser 29.

That is, if the user inputs instructions to discharge the ice to the dispenser 29, the ice discharge duct 28 is opened, and the ice stored in the ice storage 26 is delivered to the dispenser 29 and then discharged to the outside through the dispenser 29. The ice stored in the ice storage 26 is transferred from the ice storage 26 to the ice discharge duct 28 by means of a transport mechanism.

Next, it is explained how the water is supplied into the water tank 56 or 56'. When the amount of water to be stored in the water tank 56 or 56' is below a predetermined level, the valve 50V is opened and the water is supplied from the water source. The water supplied from the water source to the filter 52 is purified in the filter 52 and the purified water is then delivered into the water tank 56 or 56'through the tank tube 55 or 55'.

Here, since the water tank 56 or 56' is provided in the refrigerating chamber 3 of the refrigerator or on the door 7 or 7' of the refrigerating chamber, the water in the water tank is influenced by the temperature in the refrigerating chamber 3. That is, since the water in the water tank is kept at the same temperature in the refrigerating chamber 3, relatively cold water can be dispensed to the user through the dispenser 29.

According to the present invention as described above, the following advantages can be expected.

First, since the separately partitioned ice-making chamber is installed in the refrigerating chamber formed at a relatively upper portion of the refrigerator body, the refrigerating chamber is hardly influenced by the temperature of the ice-making chamber. Therefore, the temperatures in the ice-making chamber and the refrigerating chamber can be individually and accurately controlled. In particular, since the cold air is produced in the ice-making chamber by installing an additional evaporator in the ice-making chamber, there are advantages in that ice-making capability can be maximized and the power consumption can also be minimized.

Next, the present invention is configured in such a manner that the refrigerating chamber of which volume is relatively large is opened and closed by a plurality of doors. Thus, since the foodstuffs can be taken in and out in a state where only a portion of the refrigerating chamber is opened, there is another advantage in that the loss of cold air can be minimized.

In addition, the present invention is configured in such a manner that the doors of the refrigerating chamber are formed to have different widths rom each other and the widths of the drawer boxes in the refrigerating chamber correspond to those of the doors. Thus, there is a further advantage in that the articles can be taken in and out from the drawer boxes even though only a single door is opened.

Further, since the doors of the refrigerating chamber are divided into two, radii of rotation for opening and closing the doors are decreased. Thus, a space in front of the refrigerator needed for opening and closing the doors are also decreased. Accordingly, a space where the refrigerator is installed can be more efficiently utilized.

Furthermore, since the gaskets are installed at the opposite fir ends of the doors of the refrigerating chamber, they can be brought into close contact with each other when the doors closed. Therefore, there is an advantage in that the leakage of cold air to the outside can be minimized.

In addition, the present invention is designed such that the tubes for supplying water to the ice-making chamber and the dispenser are provided only on the refrigerating chamber side of the refrigerator body. Therefore, since the structure for supplying the water is simplified as a whole, the process of assembling the refrigerator can be simplified and the damage of the tubes can also be prevented.

Moreover, the water, which is discharged through the dispenser from the water tank installed either in the refrigerating chamber or on a rear surface of the door of the refrigerating chamber, can be always kept at the same state as in the refrigerating chamber. Further, since the water supply tubes do not pass through the refrigerating chamber side, the problems that the water in the tubes is frozen can be solved.

The scope of the present invention is not limited by the illustrated embodiments but defined by the appended claims. It will be apparent that those skilled in the art can make various modifications and changes within the scope of the invention defined by the claims.

The invention claimed is:

1. A refrigerator comprising:

a refrigerator body;

a refrigerating compartment and a freezing compartment being configured to maintain operating temperatures that differ, with the freezing compartment having an operating temperature that is lower than an operating temperature of the refrigerating compartment;

a refrigerator door configured to open and close at least a portion of the refrigerating compartment;

a dispenser positioned on the refrigerator door;

an ice compartment located in the refrigerating compartment and defined by at least one insulating wall, the at least one insulating wall including a front insulating wall;

an ice maker located in the ice compartment;

an ice storage bin;

an ice passage defined through the front insulating wall of the ice compartment; and an ice transport mechanism located in the ice compartment and configured to move ice within the ice compartment through the ice passage defined through the front insulating wall of the ice compartment.

2. The refrigerator of claim 1 wherein the ice transport mechanism is an auger.

3. The refrigerator of claim 1 wherein the ice transport mechanism is a screw wire.

4. The refrigerator of claim 1 wherein a motor for the ice transport mechanism is located in the ice compartment.

5. The refrigerator of claim 1 wherein the dispenser includes a dispensing port located on a front surface of the refrigerator door, the front surface of the refrigerator door being a surface of the refrigerator door facing an exterior of the refrigerator when the refrigerator door is oriented in a closed position.

6. The refrigerator of claim 5 wherein the dispenser includes a dispenser obstruction member movable between a first position in which the dispensing port is opened and a second position in which the dispensing port is closed, the dispensing port being configured to enable ice discharge through the refrigerator door when the dispenser obstruction member is oriented in the first position, the dispensing port being configured to at least partially prevent ice discharge through the refrigerator door when the dispenser obstruction member is oriented in the second position that differs from the first position.

7. The refrigerator of claim 1 wherein the refrigerator door is a first refrigerator door, further comprising a second refrigerator door configured to open and close a portion of the refrigerating compartment that is different than the portion of the refrigerating compartment that the first refrigerator door is configured to open and close.

8. The refrigerator of claim 7 wherein, when the second refrigerator door is oriented in a closed position, the second refrigerator door covers an area of the refrigerating compartment not covered by the first refrigerator door when the first refrigerator door is oriented in a closed position.

9. The refrigerator of claim 1 wherein the front insulating wall of the ice compartment is configured to cover a surface of the ice compartment that is otherwise exposed as a consequence of the refrigerator door being oriented in an open position.

10. The refrigerator of claim 1 wherein the front insulating wall of the ice compartment covers a front of the ice compartment, and the refrigerator door covers the front insulating wall when the refrigerator door is oriented in a closed position.

11. The refrigerator of claim 1 wherein the front insulating wall of the ice compartment is parallel to the refrigerator door when the refrigerator door is oriented in a closed position and is the at least one insulating wall that is closest to the refrigerator door when the refrigerator door is oriented in the closed position.

12. The refrigerator of claim 1 wherein the ice passage defined through the front insulating wall of the ice compartment is selectively opened and closed.

13. A refrigerator comprising:

a refrigerator body;

a refrigerating compartment and a freezing compartment being configured to maintain operating temperatures that differ, with the freezing compartment having an operating temperature that is lower than an operating temperature of the refrigerating compartment;

a refrigerator door configured to open and close at least a portion of the refrigerating compartment;

a dispenser positioned on the refrigerator door;

an ice compartment located in the refrigerating compartment and defined by at least one insulating wall, the at least one insulating wall including a front insulating wall;

an ice maker located in the ice compartment;

an ice discharge duct defined through the front insulating wall of the ice compartment; and an ice transport mechanism located in the ice compartment and configured to move ice within the ice compartment toward the ice discharge duct defined through the front insulating wall of the ice compartment.

14. The refrigerator of claim 13 wherein the front insulating wall of the ice compartment is configured to cover a surface of the ice compartment that is otherwise exposed as a consequence of the refrigerator door being oriented in an open position.

15. The refrigerator of claim 13 wherein the front insulating wall of the ice compartment covers a front of the ice compartment, and the refrigerator door covers the front insulating wall when the refrigerator door is oriented in a closed position.

16. The refrigerator of claim 13 wherein the front insulating wall of the ice compartment is parallel to the refrigerator door when the refrigerator door is oriented in a closed position and is the at least one insulating wall that is closest to the refrigerator door when the refrigerator door is oriented in the closed position.

17. The refrigerator of claim 13 wherein the ice discharge duct defined through the front insulating wall of the ice compartment is selectively opened and closed.

18. The refrigerator of claim 13 wherein the ice discharge duct penetrates through the front insulating wall of the ice compartment and is selectively opened and closed such that ice made by the ice maker in the ice compartment can be transferred to the dispenser positioned on the refrigerator door.

19. A refrigerator comprising:

a refrigerator body;

a refrigerating compartment and a freezing compartment being configured to maintain operating temperatures that differ, with the freezing compartment having an operating temperature that is lower than an operating temperature of the refrigerating compartment;

a refrigerator door configured to open and close at least a portion of the refrigerating compartment;

a dispenser positioned on the refrigerator door;

an ice compartment located in the refrigerating compartment and defined by at least one insulating wall;

an ice maker located in the ice compartment;

an ice discharge duct defined through an insulating wall of the ice compartment, wherein the ice discharge duct is selectively opened and closed such that ice made by the ice maker in the ice compartment can be transferred to the dispenser positioned on the refrigerator door; and an ice transport mechanism located in the ice compartment and configured to move ice within the ice compartment toward the ice discharge duct defined through the insulating wall of the ice compartment, wherein the insulating wall of the ice compartment through which the ice discharge duct is defined is a front insulating wall that covers a front of the ice compartment.

* * * * *